US005276627A

United States Patent [19]

Makino et al.

[11] Patent Number: 5,276,627

[45] Date of Patent: Jan. 4, 1994

[54] METHOD OF SETTING WEAVING CONDITIONS FOR A JET LOOM

[75] Inventors: Yoichi Makino; Hiroshi Tanizaki; Akio Arakawa, all of Kariya, Japan

[73] Assignee: Kabushiki Kaisha Toyoda Jidoshokki Seisakusho, Kariya, Japan

[21] Appl. No.: 982,241

[22] Filed: Nov. 25, 1992

Related U.S. Application Data

[63] Continuation of Ser. No. 534,980, Jun. 8, 1990, abandoned.

[30] Foreign Application Priority Data

Jun. 21, 1989 [JP] Japan ..... 1-158505

[51] Int. Cl.[5] ..... G06F 15/46

[52] U.S. Cl. ..... 364/470; 364/188; 139/1 R

[58] Field of Search ..... 364/470, 188, 189, 190, 364/191, 192, 146, 184; 139/1

[56] References Cited

U.S. PATENT DOCUMENTS

| | | | |
|---|---|---|---|
| 4,736,324 | 4/1988 | Sainen et al. | 364/470 |
| 4,835,699 | 5/1989 | Mallard | 364/470 |
| 4,893,250 | 1/1990 | Sainen | 364/470 |
| 5,034,897 | 7/1991 | Sainen | 364/470 |

*Primary Examiner*—Jerry Smith

*Assistant Examiner*—Thomas E. Brown

*Attorney, Agent, or Firm*—Brooks Haidt Haffner & Delahunty

[57] ABSTRACT

A method of controlling operation of a loom machine by a computer equipped with a data input unit incorporating a display imparted with a function for generating a first list of weaving conditions at least for a weft insertion apparatus and a function for generating an alteration confirmation list when the conditions in the first list are altered. Upon inputting of data representing a desired fabric parameter, weaving conditions corresponding to the fabric parameter are selected from those previously stored in the computer, whereupon the selected weaving conditions are displayed in the first list. Before the selected weaving conditions are validated for controlling the loom operation, a confirmation list is again displayed for allowing the weaving conditions to be altered. When altered, the updated list containing the altered conditions is again generated for confirmation. When acknowledgement is input for the first list or the updated list, the corresponding weaving conditions in the list are transferred to a relevant controller. By generating the display for confirmation, alteration or change of the weaving conditions as desired can be reliably effectuated without suffering errors.

5 Claims, 4 Drawing Sheets

METHOD OF SETTING WEAVING CONDITIONS FOR A JET LOOM

This application is a continuation of application Ser. No. 07/534,980, filed Jun. 8, 1990 and now abandoned.

BACKGROUND OF THE INVENTION

1. Field of the Invention

The present invention relates to a method of setting or establishing weaving conditions for a jet type weft inserting or picking system in a jet loom in accordance with desired fabric parameters such as type of yarn, width of fabric to be woven, density and texture thereof, etc. and additionally, the weaving conditions for at least one of shedding motion, warp let-off motion, take-up motion and loom rotating motion, as occasion requires.

2. Description of the Prior Art

In a jet loom, it is necessary to adjust or alter for each of the desired fabric parameters mentioned above the weaving conditions such as pressure of a jet fluid, jet timing, etc. in the weft inserting or picking motion, magnitude of shedding, timing of the shedding, height level thereof, etc. in the shedding motion, warp tension, delivery speed thereof, etc. in the warp let-off or delivery motion, take-up speed, height of cloth fell, etc. in the take-up motion, and rotating speed in the loom rotating motion. In this conjunction, there is disclosed in JP-A-63-21951 (Japanese Patent Application Laid-Open No. 21951/1988) and JP-A-63-21953 both of which are assigned to the same assignee as the present application such systems in which a number of weaving conditions are previously stored in a control apparatus for each of the fabric parameters, wherein proper or appropriate weaving conditions are automatically selected on the basis of the fabric parameters input to the control apparatus. According to this system, the optimal weaving conditions can be established within a short time without relying on the skill and experience of an operator.

It is however noted that in the case of such automatic weaving condition selecting and establishing systems, the weaving conditions selected automatically are represented by respective mean values obtained or determined heuristically through experiment and experience, and there are cases where it is necessary to set even more appropriate weaving conditions by changing or altering somewhat the automatically selected weaving conditions upon actual weaving even when the corresponding fabric parameters remain the same. Further, in certain cases, some of the weaving conditions established for a certain fabric parameter in precedence to the change thereof may preferably be used as parts of the weaving conditions even after the change of that fabric parameter.

SUMMARY OF THE INVENTION

It is therefore an object of the present invention to provide a flexible weaving condition setting method which allows the weaving conditions selected and set automatically in dependence on the input fabric parameters to be individually altered smoothly.

In view of the above object, there is provided according to a general aspect of the invention a method of establishing weaving conditions for a jet loom, in which weaving conditions relevant to a jet type weft insertion or picking at the least are previously set in control means for each of the desired fabric parameters such as type of yarn, width of fabric to be woven, density and textures thereof, etc. The control means automatically selects or arithmetically determines from the preset weaving conditions the conditions for allowing the weaving to be performed in conformance with a desired fabric parameter input to the control means through data input means. A display is connected to the control means for displaying the weaving conditions selected or established by the control means. A list of the preset weaving conditions selected or determined in accordance with the input fabric parameter is generated by the control means on said display means for allowing alteration or change of the preset weaving conditions being displayed. Upon alteration of the preset weaving conditions, a confirmation list containing the updated weaving conditions inclusive of the altered weaving conditions is displayed for confirmation of the alteration. The weaving conditions contained in the confirmation list are validated only in the state in which the confirmation list is being displayed.

According to the teaching of the invention, the weaving conditions conforming to the desired fabric parameters as input are selected and displayed for allowing the weaving conditions to be individually changed or altered for each of the fabric parameters, which is then followed by sequential generations of displays of the updated weaving conditions for confirmation. By inputting acknowledgement, the displayed weaving conditions are validated. In this manner, only the weaving conditions that are to be altered or changed can be changed correctly without fail.

BRIEF DESCRIPTION OF THE DRAWINGS

A more detailed understanding of the present invention may be had from the following description of a preferred embodiment thereof, given by way of example only and to be read and understood in conjunction with the accompanying drawings, in which.

DESCRIPTION OF THE PREFERRED EMBODIMENT

Figure 1:
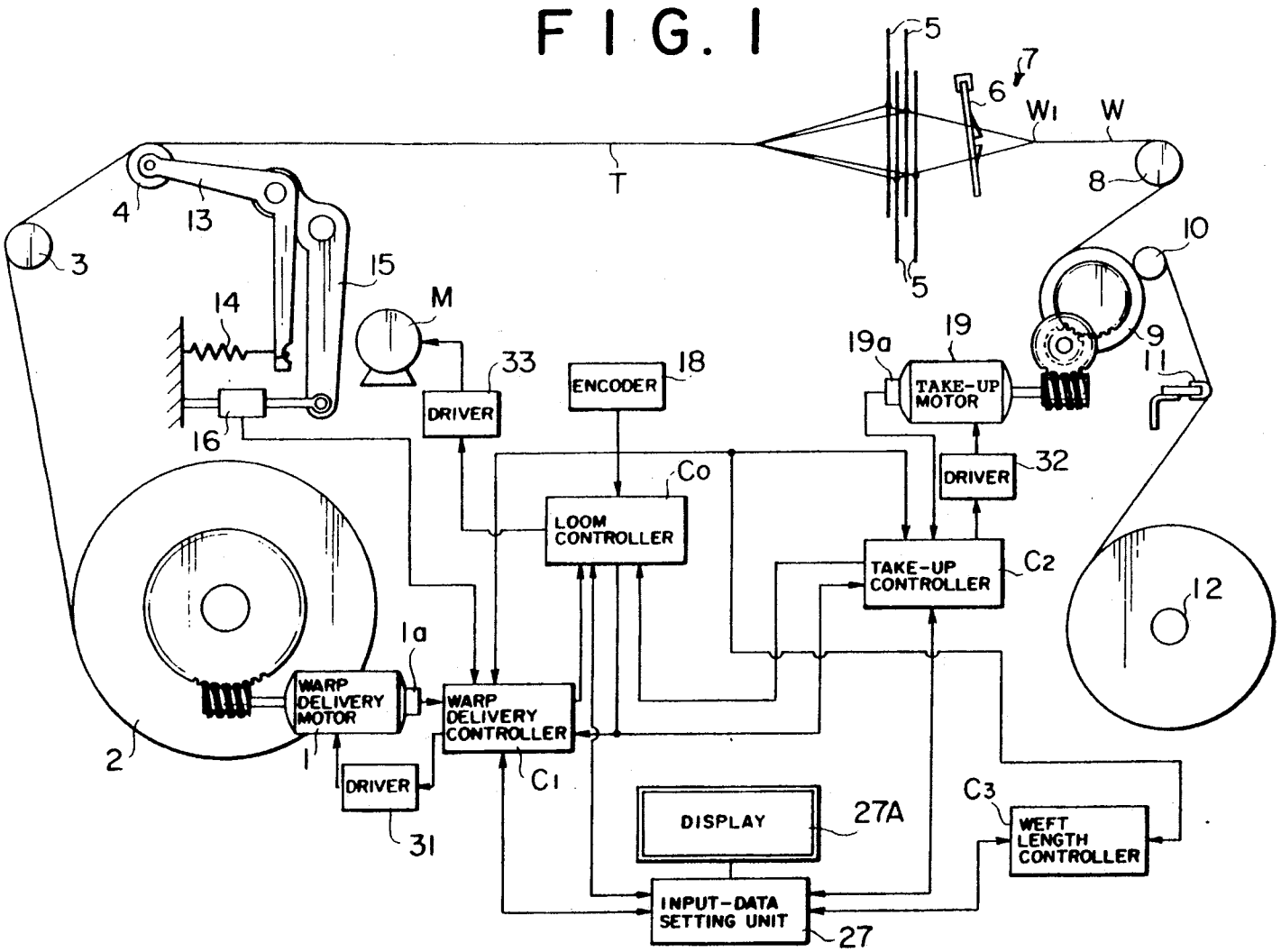
FIG. 1 is a schematic side elevational view showing a general arrangement of a loom incorporating a preferred embodiment of the present invention.

Referring to the drawings and in particular to FIG. 1, there is shown schematically in a side elevational view a general arrangement of a jet loom together with a preferred or exemplary embodiment of the present invention. In the figure, a loom driving electric motor M is connected to a loom control computer or controller $C_0$ through the medium of a driver circuit 33 so that operation of the motor M is placed under the control of the loom controller $C_0$. The loom is further equipped with a reversible warp let-off or delivery motor 1 independent of the loom driving motor M. A warp T delivered from a warp beam 2 driven by the warp delivery motor 1 is guided through a back-up roller 3 and a tension roller 4 toward a weaving assembly 7 which includes a heald frame 5, a modified reed 6 for forming a weft guide passage (not shown) in a manner well known in the art, a weft inserting or picking mechanism (not shown in FIG. 1) and others, wherein the weft is woven into fabric W at a cloth fell $W_1$ by the weaving assembly 7. The fabric W as woven is wound up by a take-up shaft 12 by way of an expansion bar 8, a surface roller 9, a press roller 10 and a wrinkle smoothing guide member 11.

The tension roller 4 is mounted on a substantially L-like tension lever 13 at a free end of one leg portion thereof, while the other leg of the L-like tension lever 13 is coupled at a free end thereof to a portion of the loom through a tension spring 14 so that the tension lever 13 is rotated about a bent base portion thereof under the bias of the tension spring 14 to thereby impart a predetermined tension to the warp T. The bent base portion of the L-like tension lever 13 is pivotally or rotatably supported by a detection lever 15 at one end thereof, the detection lever 15 having the other end which is coupled to a load cell 16. In this manner, the tension of the warp T is transmitted to the load cell 16 through the tension lever 13 and the detection lever 15, whereby the load cell 16 outputs an electrical signal representative of the tension applied to the warp T, which signal is then supplied to a warp delivery control computer or controller $C_1$.

The warp delivery controller $C_1$ is connected to an input data setting unit 27 incorporated in the jet loom and adapted to control the rotating speed of the warp delivery feed motor 1 through a driver circuit 31 on the basis of the result of comparison between a preset tension input previously to the controller $C_1$ through the input data setting unit 27 and the actually detected tension represented by the signal supplied from the load cell 16, an initial warp beam diameter preset by the input data setting unit 27 which also serves as an input control means, a warp beam diameter calculated from the input data of texture pattern and the like and a detection signal supplied from a rotary encoder 18 for detecting a rotation angle of the loom frame.

In this way, the tension of the warp is controlled during the ordinary weaving operation to prevent the occurrence of barré. Further, the rotating speed of the warp delivery motor 1 is subjected to a feedback control performed by the warp delivery controller $C_1$ on the basis of a rotating speed detection signal generated by a rotary encoder 1*a* incorporated in the warp delivery motor 1.

The surface roller 9 is operatively connected to a reversible take-up motor 19 provided independent of the loom driving motor M. Operation of the take-up motor 19 is controlled by a take-up control computer or controller $C_2$. More specifically, the rotating speed of the take-up motor 19 is subjected to feedback control of the take-up controller $C_2$ through a driver circuit 32 on the basis of a rotating speed detection signal generated by a rotary encoder 19*a* built into the take-up motor 19.

Figure 2:
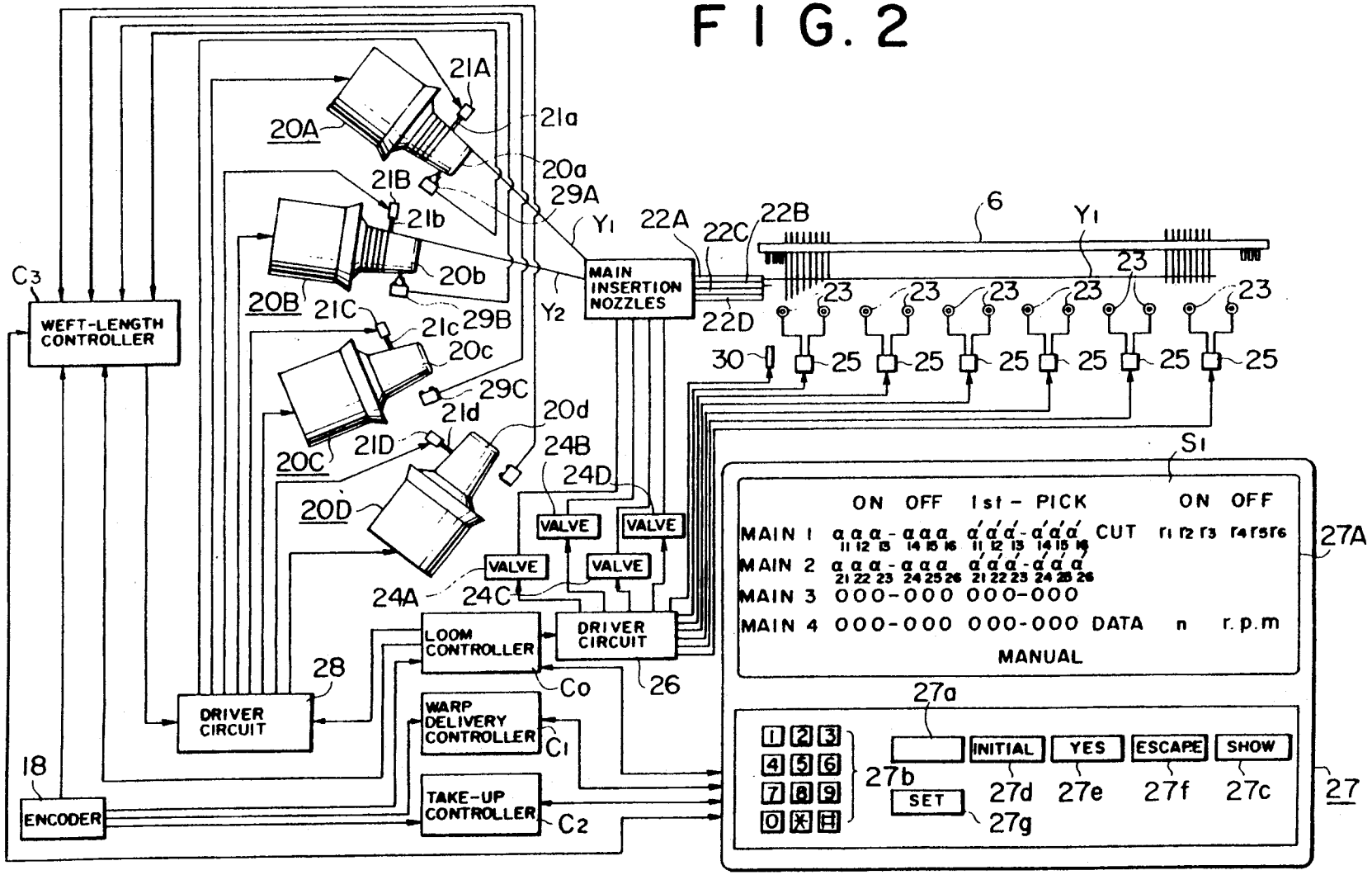
FIG. 2 is a plan view showing schematically an arrangement for a weft inserting or picking motion in the loom shown in FIG. 1.

Referring to FIG. 2, reference symbols 20A, 20B, 20C and 20D denote weft length measurement/storage units for winding wefts $Y_1$ and $Y_2$ on and around drums 20*a*, 20*b*, 20*c* and 20*d* which define weft measurement and storage surfaces, respectively, under actuation of respective associated electric motors. In the weft length sizing/reserving units, the wefts wound on the drums 20*a*, 20*b*, 20*c* and 20*d* are selectively pulled into weft inserting main nozzles 22A, 22B, 22C and 22D, respectively, through the weft retaining members 21*a*, 21*b*, 21*c* and 21*d* acting on the weft winding drum surfaces, being driven by associated solenoids 21A, 21B, 21C and 21D, respectively. The wefts $Y_1$ and $Y_2$ pulled out from the weft length measurement and storage units 20A, 20B, 20C and 20D are jetted to be inserted in a shedding from the weft inserting main nozzles 22A, 22B, 22C and 22D under the action of jet flows therefrom to be subsequently projected along the modified reed 6 under the action of successive jets produced sequentially by a plurality of weft insertion aiding nozzles 23. The wefts $Y_1$ and $Y_2$ inserted in the shedding in this manner are cut away by an electromagnetic cutter 30 immediately after having been beaten by the reed. The jet flow supplied to the weft inserting main nozzles 22A, 22B, 22C and 22D is controlled by electromagnetically operated valves 24A, 24B, 24C and 24D, respectively, while the jet flows supplied to the weft insertion aiding nozzles 23 are controlled by electromagnetically operated valves 25, respectively.

The valves 24A, 24B, 24C and 24D respond to control commands supplied from the loom control computer or controller $C_0$ through a driver circuit 26, whereby a selected one of the valves 24A, 24B, 24C and 24D is opened with the others being closed in accordance with, for example, weft color select pattern data previously loaded in the input data setting unit 27.

The opening/closing (on/off) operation of the valves 24A, 24B, 24C and 24D is performed at a predetermined angular position of the loom on the basis of a detection signal fetched from the rotary encoder 18 by the loom controller $C_0$. On the other hand, the solenoids 21A, 21B, 21C and 21D undergo energization/deenergization (on/off) control of a weft length control computer or controller $C_3$ through a driver circuit 28. More specifically, one of the solenoids 21A, 21B, 21C and 21D is selectively energized with the others being deenergized by the weft length controller $C_3$ in accordance with the preset weft color pattern data, whereby the weft $Y_1$ or $Y_2$ to be selectively inserted is jetted from the associated one of the weft inserting main nozzles 22A, 22B, 22C and 22D at a predetermined angular position of the loom.

Disposed in the vicinity of the drums 20*a*, 20*b*, 20*c* and 20*d* of the weft length measurement/storage units 20A, 20B, 20C and 20D are weft releasing sensors 29A, 29B, 29C and 29D, respectively, which serves to detect the wefts pulled out and released from the drums 20*a*, 20*b*, 20*c* and 20*d*, respectively. The detection signal output from the sensors 29A, 29B, 29C or 29D is supplied to the weft length controller $C_3$ which in turn controls the operation of the associated weft winding motor and hence the delivery of the weft through the driver circuit 28 in accordance with the weft detection signal for each of the weft length measurement/storage units 20A, 20B, 20C and 20D.

Loaded previously in the input data setting unit 27 connected to each of the controllers $C_0$, $C_1$, $C_2$ and $C_3$ are a number of sets of weaving conditions which are adapted to be selectively displayed on a display screen 27A incorporated in the input data setting unit 27. When a key 27*a* provided on the input data setting unit 27 for allowing a desired fabric parameter to be input is pressed, the input data setting unit 27 responds thereto by displaying a corresponding set of weaving conditions (i.e. a list of weaving conditions) on the screen 27A. With the aid of the numeral keys 27*b* and a set key 27*g* labeled "SET", the desired fabric parameter can be input to the input data setting unit 27, which then selects a corresponding set of weaving conditions from a number of sets of weaving conditions in accordance with the input fabric parameter which may be related to the type of yarn, the width of fabric, density of fabric, texture of fabric, etc.

In FIG. 2, there is shown an initial display or list $S_1$ of the itemized weaving conditions generated on the display screen 27A for the weft inserting (picking) motion. By actuating a key labeled "SHOW" and denoted by 27*c* successively, the input data setting unit 27 can generate sequentially for every fabric parameter the initial lists of weaving conditions for weft insertion, shedding, warp delivery (let-off), loom rotation and take-up motions, respectively. Parenthetically, the operation for generating the displays of the weaving conditions for every fabric parameter may be realized by individually providing the corresponding keys in the input data setting unit in place of the single key "SHOW" 27*c*.

Referring to the display 27A shown in FIG. 2, "MAIN 1" corresponds to the electromagnetic valve 24A, "MAIN 2" corresponds to the electromagnetic valve 24B, "MAIN 3" corresponds to the electromagnetic valve 24C, and "MAIN 4" corresponds to the electromagnetic valve 24D. Further, "CUT" represents the electromagnetic cutter 30. The item "DATA" represents the loom rotation speed which is one of the weaving conditions, wherein a letter "n" annexed to "DATA" represents the loom rotation number per unit time (rotations per minute or r.p.m in the case of the illustrated embodiment). The weaving conditions concerning the weft insertion or picking shown in this initial weaving condition list $S_1$ are for the two different color weft picking to be performed by using two main nozzles 22A and 22B for the weft insertion. The normal time point at which the electromagnetic valve 24A is opened (turned on) is indicated in terms of the loom rotation angle $\alpha_{11}\alpha_{12}\alpha_{13}$ (a three place decimal number, wherein $\alpha_{13}$, $\alpha_{12}$ and $\alpha_{11}$ represent the first, second and the third orders of magnitude, respectively, with the same notation applying valid to the representation of the other angles). The normal closing (off) time point of the electromagnetic valve 24A is given in terms of the loom rotation angle $\alpha_{14}\alpha_{15}\alpha_{16}$. On the other hand, the normal opening (on) timing for the electromagnetic valve 24B is given in terms of the loom rotation angle of $\alpha_{21}\alpha_{22}\alpha_{23}$, while the ordinary closing (off) timing is given in terms of the loom rotation angle $\alpha_{24}\alpha_{25}\alpha_{26}$. Further, the valve opening (on) timing of the electromagnetic valve 24A for the first weft insertion (picking) upon start of the loom operation is given in terms of the loom rotation angle $\alpha'_{11}\alpha'_{12}\alpha'_{13}$ with the valve closing (off) timing thereof being given in terms of the loom rotation angle $\alpha'_{14}\alpha'_{15}\alpha'_{16}$. On the other hand, the valve opening (on) timing of the electromagnetic valve 24B for the first weft insertion (picking) is given in terms of a loom rotation angle of $\alpha'_{21}\alpha'_{22}\alpha'_{23}$ with the valve closing (off) timing thereof being represented by $\alpha'_{24}\alpha'_{25}\alpha'_{26}$. Further, the timing at which the electromagnetic cutter 30 is to be energized (turned on) is represented in terms of a loom rotation angle of $\gamma_1\gamma_2\gamma_3$ with the deenergization (off) timing being given by $\gamma_4\gamma_5\gamma_6$.

The data of the weaving conditions shown in the initial list $S_1$ are transferred to the loom controller $C_0$ to be registered therein through corresponding operation of the input data setting unit 27 so that the loom controller $C_0$ performs the on/off (open/close) operation of the electromagnetic valves 24A and 24B on the basis of the registered weaving conditions for the weft picking motion.

Figure 3:
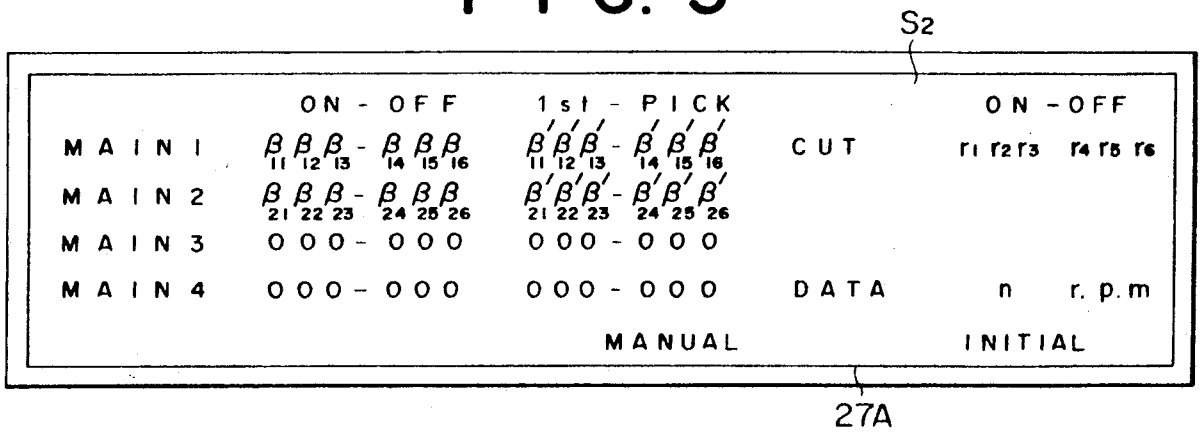
FIGS. 3 to 6 are views for illustrating contents of displays generated on a display unit, respectively.

Now assuming, by way of example, that the fabric parameter concerning the width of fabric for the weaving conditions being generated on the display is to be changed, the weaving conditions are then correspondingly altered or updated and displayed in the form of a list display $S_2$ for the weft picking motion, as shown in FIG. 3. This selective alteration is performed by the input data setting unit 27. The weaving conditions itemized in the list display $S_2$ of FIG. 3 are set only provisionally. In other words, the itemized weaving conditions displayed in the list $S_2$ are checked in the manner described below.

Figure 4:
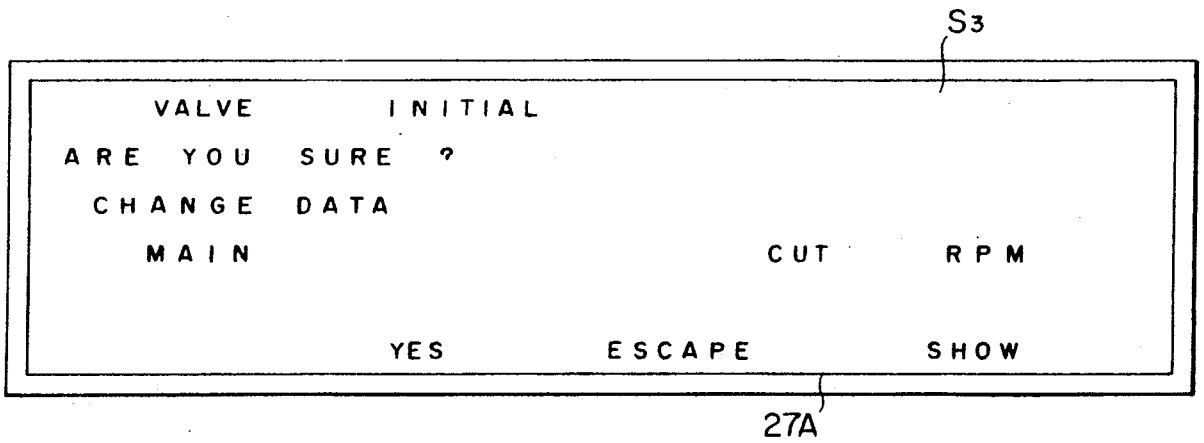
Figure 6:
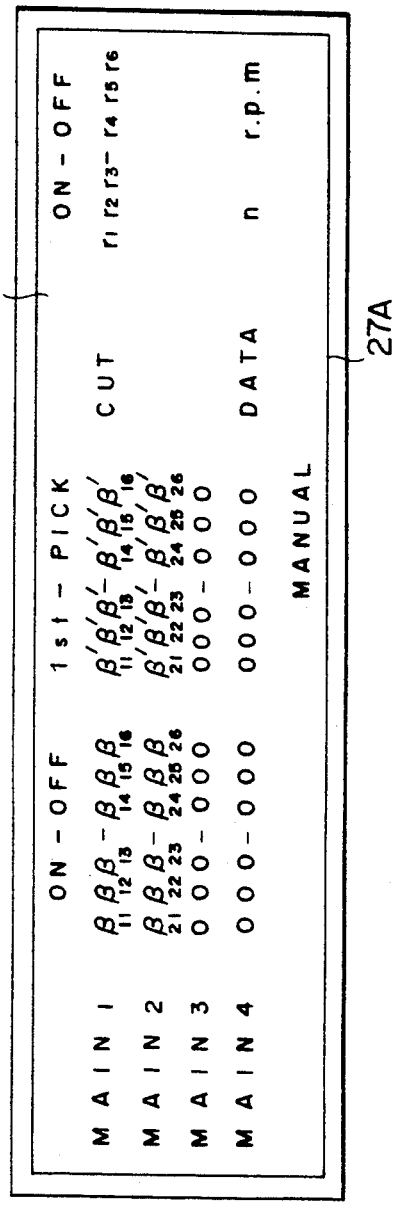

When a key 27*d* labeled "INITIAL" (FIG. 2) is pushed in the state in which the list display $S_2$ is being generated, as illustrated in FIG. 3, the input data setting unit 27 generates a first alteration confirming display $S_3$ concerning the altered weaving conditions for the weft insertion, as illustrated in FIG. 4. When a key 27*e* (FIG. 2) corresponding to the prompt "YES" displayed on the alteration confirmation display $S_3$ is actuated, the input data setting unit 27 responds to the actuation of the key 27*e* by transferring the selectively altered weaving conditions for the weft insertion to the loom controller $C_0$ and at the same time generates an initial weaving condition list $S_5$ that has undergone the alteration, as illustrated in FIG. 6. The loom controller $C_0$ then registers the altered or updated weaving conditions transferred thereto in place of the precedingly registered weaving conditions for the weft insertion. In this manner, the setting of the weaving conditions concerning the weft insertion are fixed.

Figure 5:
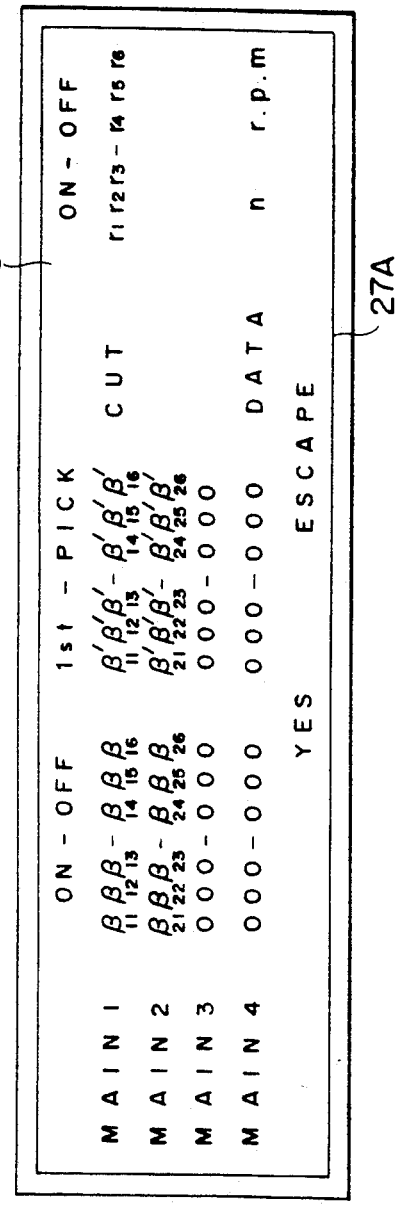

When the contents of the itemized weaving conditions are to be checked before the itemized weaving conditions are fixed and immediately after generation of the alteration confirmation display $S_3$, this can be accomplished simply by actuating a key 27*c* (FIG. 2) corresponding to the prompt "SHOW" displayed on the alteration confirmation display $S_3$. Then, the input data setting unit 27 responds to the actuation of the key 27*c* by generating a second alteration confirmation display $S_4$ such as shown in FIG. 5. When the key 27*e* (FIG. 2) corresponding to "YES" is actuated in the state in which the second alteration confirmation display $S_4$ is being generated, the input data setting unit 27 responds to the actuation of the "YES" key 27*e* by transferring the selectively altered weaving conditions for the weft insertion to the loom controller $C_0$ and at the same time generates the altered initial weaving condition list $S_5$, whereon the weaving conditions for the weft insertion is fixedly established.

When the weaving conditions are to be altered in respect to only conditions irrelevant to the warp delivery, such as type of weft yarn, there may arise such a case in which it is preferred to use the weaving conditions not altered for the warp let-off motion, by way of example. In such case, a key 27*f* (FIG. 2) corresponding to the prompt "ESCAPE" and indicated on the first and second alteration confirmation displays $S_3$ and $S_4$ may be actuated. Then, the input data setting unit 27 generates the initial weaving condition display $S_1$ before alteration of the weaving conditions shown in FIG. 2 without transferring the weaving conditions to the loom controller $C_0$. Consequently, the weaving conditions not altered for the warp let-off motion are continuously retained as they are registered in the loom control computer $C_0$ which thus controls the delivery motor 1 in response to the electric signal produced by the load cell 16 in accordance with the weaving conditions not altered for the warp delivery.

The weaving conditions can be altered with the aid of numeral keys 27b and a set key 27g in the state in which the initial weaving condition list or display $S_1$ shown in FIG. 2 is being generated, whereby the itemized weaving conditions selected automatically can further be adjusted finely so as to establish the more appropriate weaving conditions. The selection of itemized weaving conditions that have been altered as mentioned above for transfer to the loom control computer $C_0$ can be performed only in the state in which the first alteration confirmation display $S_3$ or the second alteration confirmation display $S_4$ is being generated.

Similar set data confirmation may selectively be performed as to the weaving conditions for the shedding, the warp let-off, the take-up, the loom rotating motions etc. as described hereinbefore, wherein the weaving conditions can be finally established or validated only in the state in which the first or second alteration confirmation display for the relevant weaving conditions is being generated on the display screen 27A. More specifically, the establishment or validation of the weaving conditions for the warp delivery can be realized by selecting the relevant weaving conditions for the transfer to the delivery controller $C_1$ in the state in which the relevant weaving condition list is being displayed, while validation of the weaving conditions for the take-up motion is effectuated by selecting the relevant weaving conditions for the transfer to the take-up controller $C_2$ when the relevant weaving conditions are being displayed. Similarly, establishment of the weaving conditions concerning the loom rotation is validated by selecting the relevant weaving conditions for the transfer to the loom controller $C_0$ only in the state where the relevant weaving conditions are being displayed. In this way, when the weaving conditions unaltered are to be adopted even after alteration of the weaving conditions, i.e. when the weaving conditions selectively altered are not to be transferred to the associated controller, such unwanted transfer is positively prevented, whereby the inputting and setting of data representing the proper or correct weaving conditions can be performed smoothly.

As will now be appreciated from the foregoing description, it is possible according to the teaching of the present invention to determine or validate the setting of the itemized weaving conditions indicated on the display only when the command for validation is input in the state in which the alteration confirmation display corresponding to the weaving conditions is being generated, whereby decision as to whether the automatically selected weaving conditions are to be suitably adopted or not can be made on the parameter basis, making it possible to establish and validate the weaving conditions smoothly without errors.

It is thought that the present invention will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. A method of establishing weaving conditions for a jet loom, in which a plurality of weaving conditions relevant at least to a jet type weft insertion apparatus are preset in control means for each of a number of desired fabric parameters, said control means automatically selecting and arithmetically determining on the basis of said preset weaving conditions the conditions for causing the weaving to be performed in conformity with the desired fabric parameter input to said control means through data input means, said method comprising the steps of:

providing display means connected to said data input means and said control means;

generating on said display means a list of each of the preset weaving conditions in said control means conforming to an input fabric parameter for allowing individual ones of said preset weaving conditions to be altered before release to said control means;

altering at least one of said preset weaving conditions using said data input means, thereafter generating a revised list on said display means of the updated weaving conditions containing any altered weaving conditions for confirmation of each alteration;

verifying the correctness of the updated weaving conditions as displayed by said display means and through said data input means alternatively further altering said weaving conditions or signifying initial acceptance thereof;

providing a prompting display on said display means and requiring an operator to select through said data input means as between abandoning any change, reviewing the change, or accepting the change; and upon accepting the change, releasing the updated weaving conditions shown in said revised list display to said control means to update said preset weaving conditions therein for said parameter.

2. A method of establishing weaving conditions for a jet loom according to claim 1, wherein the weaving conditions relevant to a warp delivery apparatus are additionally preset.

3. A method of establishing weaving conditions for a jet loom according to claim 1, wherein before verifying the weaving conditions contained in said updated weaving condition list, information indicating whether a second list for confirmation can be generated or not is displayed on said display means together with said first list, said second display list being generated together with prompting for acknowledgement when said second confirmation list is generated by a command input through said input means, and said updated weaving conditions being transferred to a controller for controlling loom operation to be verified and at the same time displayed on said display means when said acknowledgement is input through said input means.

4. A method of establishing weaving conditions for a jet loom according to claim 2, wherein escape information indicating whether said updated weaving conditions are to be invalidated or not is displayed together with said first confirmation list, the initial list before the alteration being generated again in response to an affirmative acknowledgement input through said input means with said updated weaving conditions being transferred to a controller for controlling a warp delivery apparatus when the weaving conditions are to be altered with respect to only conditions irrelevant to a warp delivery, said controller holding the weaving conditions before the alteration as registered therein for thereby controlling rotation of a delivery motor of said warp delivery apparatus in accordance with the weaving conditions before the alteration.

5. A method for establishing weaving conditions in a control means for a jet loom, in which weaving conditions relevant at least to weft insertion are preset in said control means for each of a number of desired fabric parameters, said control means automatically selecting and arithmetically determining, on the basis of said preset weaving conditions, apparatus settings of said jet loom under which weaving will be performed, comprising the steps of:

providing data input means for electrically altering apparatus settings of said control means, and display means operatively connected to said data input means for displaying said control means settings;

manually generating in said data input means and displaying on said display means data for at least one preset weaving condition representing the setting of said control means corresponding to a fabric parameter to enable manual selective alteration thereof;

altering any of said displayed preset weaving conditions by manual input to said data input means;

manually inputting to said data input means an initial acceptance of said altered weaving conditions and displaying on said display means, upon said alteration of each said preset weaving condition, a confirmation display requiring confirmation of the alteration;

verifying the altered weaving conditions contained in said confirmation display as a result of said manual input to said data input means and through said data input means alternatively further altering said weaving conditions or signifying initial acceptance thereof;

providing a prompting display on said display means and requiring an operator to select through said data input means as between abandoning any change, reviewing the change, or accepting the change; and upon accepting the change, manually releasing the weaving conditions then contained in said data input means to said control means to update said weaving conditions in the latter.

* * * * *